US009212342B2

(12) United States Patent
Ramirez et al.

(10) Patent No.: US 9,212,342 B2
(45) Date of Patent: Dec. 15, 2015

(54) WRINKLE REDUCING AND DEODORIZING DRYER SHEET AND METHODS OF MAKING AND USING

(71) Applicant: JR Chem LLC, Miami, FL (US)

(72) Inventors: Jose E. Ramirez, Miami, FL (US); Donna F. Ramirez, Miami, FL (US)

(73) Assignee: JR Chem LLC, Miami, FL (US)

( * ) Notice: Subject to any disclaimer, the term of this patent is extended or adjusted under 35 U.S.C. 154(b) by 0 days.

(21) Appl. No.: 14/296,540

(22) Filed: Jun. 5, 2014

(65) Prior Publication Data

US 2015/0126430 A1 May 7, 2015

Related U.S. Application Data

(60) Provisional application No. 61/831,733, filed on Jun. 6, 2013.

(51) Int. Cl.

| | |
|---|---|
| ***C11D 17/00*** | (2006.01) |
| ***C11D 17/04*** | (2006.01) |
| ***C11D 3/30*** | (2006.01) |
| ***C11D 1/645*** | (2006.01) |
| ***C11D 3/00*** | (2006.01) |
| *C11D 1/62* | (2006.01) |

(52) U.S. Cl.
CPC ..... *C11D 17/047* (2013.01); *C11D 1/645* (2013.01); *C11D 3/0068* (2013.01); *C11D 3/30* (2013.01); *C11D 1/62* (2013.01)

(58) Field of Classification Search
CPC ..... C11D 17/041; C11D 17/047
USPC ..... 510/520
See application file for complete search history.

(56) References Cited

U.S. PATENT DOCUMENTS

| | | | | | |
|---|---|---|---|---|---|
| 4,110,498 | A * | 8/1978 | Benjamin et al. | ..... | 427/242 |
| 4,170,678 | A * | 10/1979 | Urfer et al. | ..... | 428/124 |
| 4,177,151 | A * | 12/1979 | Siu et al. | ..... | 510/520 |
| 2010/0000116 | A1* | 1/2010 | Aouad et al. | ..... | 34/427 |
| 2013/0247306 | A1* | 9/2013 | Petkus et al. | ..... | 8/137 |

* cited by examiner

*Primary Examiner* — John Hardee
(74) *Attorney, Agent, or Firm* — Perman & Green, LLP

(57) ABSTRACT

Provided are wrinkle reducing and deodorizing dryer sheets and methods of making and using the dryer sheets. In one form of the dryer sheet, the wrinkle reducing and deodorizing dryer sheet includes an absorbent wet substrate in sheet form with a polyvinyl alcohol sheet adhered to one surface of the substrate. In another form the PVA sheet is added separately from that of the absorbent wet substrate sheet. The PVA sheet is preferably in the form of an uncoated non-woven of a thickness of 8 mil or less. The wet impregnated sheet contains a solution of quaternary ammonium salts of different water solubility. The method for using, the wrinkle reducing and deodorizing dryer sheet is added to a rotary dryer with a load of wet or dried garments to reduce wrinkling in the garments during the drying process, reduce static cling and refresh the treated clothing.

22 Claims, 1 Drawing Sheet

| Sheet 1 | |
|---|---|
| Layer 1 | Polyvinylalcohol to "sticky" side of layer 2 |
| Layer 2 | PVC - Contact page (glue on one side) |
| Layer 3 | Polyester "soaked" with Quats (non-glued side of layer 2 |

| Sheet 2 | |
|---|---|
| Layer 3 | Polyester "soaked" with Quats (non-glued side of layer 2 |
| Layer 2 | PVC - Contact page (glue on one side) |
| Layer 1 | Polyvinylalcohol to "sticky" side of layer 2 |

| Sheet 3 | |
|---|---|
| Layer 1 | Polyvinylalcohol to "sticky" side of layer 2 |
| Layer 2 | PVC - Contact page (glue on one side) |
| Layer 3 | Polyester "soaked" with Quats (non-glued side of layer 2 |

| Sheet 4 | |
|---|---|
| Layer 3 | Polyester "soaked" with Quats (non-glued side of layer 2 |
| Layer 2 | PVC - Contact page (glue on one side) |
| Layer 1 | Polyvinylalcohol to "sticky" side of layer 2 |

| Sheet 1 | |
|---|---|
| Layer 1 | Polyvinylalcohol to "sticky" side of layer 2 |
| Layer 2 | PVC - Contact page (glue on one side) |
| Layer 3 | Polyester "soaked" with Quats (non-glued side of layer 2 |

| Sheet 2 | |
|---|---|
| Layer 3 | Polyester "soaked" with Quats (non-glued side of layer 2 |
| Layer 2 | PVC - Contact page (glue on one side) |
| Layer 1 | Polyvinylalcohol to "sticky" side of layer 2 |

| Sheet 3 | |
|---|---|
| Layer 1 | Polyvinylalcohol to "sticky" side of layer 2 |
| Layer 2 | PVC - Contact page (glue on one side) |
| Layer 3 | Polyester "soaked" with Quats (non-glued side of layer 2 |

| Sheet 4 | |
|---|---|
| Layer 3 | Polyester "soaked" with Quats (non-glued side of layer 2 |
| Layer 2 | PVC - Contact page (glue on one side) |
| Layer 1 | Polyvinylalcohol to "sticky" side of layer 2 |

WRINKLE REDUCING AND DEODORIZING DRYER SHEET AND METHODS OF MAKING AND USING

CROSS-REFERENCE TO RELATED APPLICATION

This application is a non-provisional of and claims the benefit of U.S. Provisional Patent Application No. 61/831,733 filed on Jun. 6, 2013, the disclosure of which is incorporated herein by reference in its entirety.

BACKGROUND

1. Field

The exemplary embodiments relate to dryer sheets and methods of using the dryer sheets in rotary clothes dryers. It more particularly relates to dryer sheets with improved anti-wrinkle and deodorizing properties for use with cotton and permanent press garments and clothing.

2. Brief Description of Related Developments

Dryer sheets are commonly available for use in a dryer with a load of laundry for imparting anti-static properties, fabric softening properties, and fragrance to the laundry during a drying cycle. Dryer sheets are generally cationic in nature and help to neutralize the residual negative anionic charge in clothes from the washing process and the static cling (excess of negative charge) imparted to clothes during the drying process. Exemplary dryer sheets are available under the names Bounce® and Downy® from The Procter & Gamble Company. In general, the dryer sheet includes a nonwoven fabric substrate and a composition that includes an anti-static agent or fabric softening agent, and a fragrance. During the drying cycle, the temperature increases as the laundry dries, causing the anti-static agent or the fabric softening agent to melt and transfer from the nonwoven substrate to the clothes or garments. Dryer sheets are generally provided for single use, and are discarded after use. Dryer sheets containing fabric softeners are described by U.S. Pat. No. 3,442,692, U.S. Pat. No. 3,686,025, U.S. Pat. No. 4,834,895; U.S. Pat. No. 5,041,230, and U.S. Pat. No. 5,145,595, each of which is herein incorporated by reference in their entirety.

With respect to "dry dryer sheets," one product of this type is commercially available from The Proctor & Gamble Company of Cincinnati, Ohio under the trademark Bounce® Dryer sheets of this type generally consist of sheets of non-woven material impregnated with a composition usually consisting of a cationic softening agent, antistatic agents, dispersing agents and a fragrance. The softening or other fabric treating agent is applied to the non-woven material and then dried in an oven so that it is completely "dry" when ready for use. One or more dry dryer sheets are placed into a rotary clothes dryer with freshly laundered, damp items of clothing, where they remain for the entire drying cycle. The composition on the sheet of non-woven material is released in the course of the drying cycle as a result of the heat within the clothes dryer, and contact with the clothing induced by the tumbling action of the dryer. The water repellency of the conditioning materials is key to the slow release to the wet clothing until higher temperatures are obtained and a slow transfer of the waxy-like conditioning antistatic agents is achieved.

With respect to "wet dryer sheets", one product of this type is commercially available from Church and Dwight Company of Princeton, N.J. under the trademark of Arm and Hammer 2 in 1 Dryer Sheets®. Dryer sheets of this type generally consist of sheets of non-woven material impregnated with a liquid composition usually consisting of a cationic softening agent, anti-static agents, dispersing agents and a fragrance. One or more wet dryer sheets are placed into a rotary clothes dryer with freshly laundered, damp items of clothing, where they remain for the entire drying cycle. The composition of the sheet is released in the course of the drying cycle as a result of the heat within the clothes dryer, and contact with clothing induced by tumbling action of the dryer.

Prior art dry dryer sheets described above also have a number of limitations. One of these limitations is that they have limited effectiveness for preventing the wrinkling of garments and clothing during the drying process and have little or no sanitizing effect. In particular, a relatively high temperature is required in order to activate the softening or other fabric treating agent on the non-woven sheet and release it into the fabric of the clothing.

Hence, there is a need for a dryer sheet with improved anti-wrinkle and deodorizing properties when used in rotary clothes dryers. There is also a need for improved methods of using dryer sheets with improved anti-wrinkle and deodorizing properties during the clothes drying process.

SUMMARY

According to the disclosed embodiments, an advantageous wrinkle reducing dryer sheet includes a first outer layer of a polyvinyl alcohol substrate having a thickness of from 0.5 to 8 mils, a second outer layer of an absorbent flexible non-woven substrate saturated with a solution including a combination of hydrophobic and hydrophilic cationic ingredients having a thickness of from 1 to 20 mils, and at least one water impermeable adhesive layer having a thickness of from 0.1 to 2 mils between the first outer layer and the second outer layer.

A further aspect of the disclosed embodiments relates to an advantageous wrinkle reducing dryer sheet kit including a polyvinyl alcohol substrate having a thickness of from 0.5 to 8 mils packaged in perforated roll or stacked sheet form and an absorbent flexible non-woven substrate saturated with a solution including a combination of hydrophobic and hydrophilic cationic ingredients having a thickness of from 1 to 20 mils packaged in perforated roll or stacked sheet form, wherein the polyvinyl alcohol substrate and the absorbent flexible non-woven substrate are provided in one or two containers separated from one another during storage.

Another aspect of the disclosed embodiments relates to an advantageous method of reducing wrinkling of clothing and/or garments in rotary clothes dryers including placing a load wet laundered cotton and/or permanent press clothing and/or garments in a rotary clothes dryer, adding to the rotary clothes dryer prior at the start of a drying cycle a non-woven polyvinyl alcohol substrate having a thickness of from 0.5 to 8 mils, drying the load of laundered cotton and/or permanent press clothing and/or garments at a sufficient dryer time and a sufficient dryer temperature sufficient to dry the load of laundered cotton and/or permanent press clothing.

These and other features and attributes of the disclosed wrinkle reducing dryer sheet, dryer sheet kit and methods of reducing wrinkling of clothing and/or garments in rotary clothes dryers of the disclosed embodiments and their advantageous applications and/or uses will be apparent from the detailed description which follows, particularly when read in conjunction with the figures appended hereto.

BRIEF DESCRIPTION OF DRAWINGS

To assist those of ordinary skill in the relevant art in making and using the subject matter hereof, reference is made to the appended drawing, wherein:

FIGURE is cross-sectional schematic depicting the stacking arrangement of the wrinkle reducing and deodorizing dryer sheets of the instant disclosure when sheets are provided in a stacked arrangement in a single container for dispensing.

DETAILED DESCRIPTION

All numerical values within the detailed description and the claims herein are modified by "about" or "approximately" the indicated value, and take into account experimental error and variations that would be expected by a person having ordinary skill in the art.

The disclosed embodiments provide dryer sheets with improved anti-wrinkle and deodorizing properties and methods of making and using the dryer sheets in rotary clothes dryers. The Applicant has unexpectedly and surprisingly discovered that when a polyvinyl alcohol layer or sheet is used in combination with an absorbent flexible sheet or layer including a combination of hydrophilic quats and hydrophobic quats, there is a reduction in the propensity for fabric and garment wrinkling during the rotary drying process. The hydrophilic quats may be water soluble compounds, whereas the hydrophobic quats may be fatty amines.

The wrinkle reducing and deodorizing dryer sheets of the disclosed embodiments are suitable for use with cotton, cotton treated, composite cotton permanent press clothing and/or garments which tend to undergo significant wrinkling during the drying process. However, the wrinkle reducing and deodorizing dryer sheets of the disclosed embodiments are also suitable for use with clothing, garments, and bedding made from other types of materials, including, but not limited to, acetate, acrylic, linen, nylon, polyester, polyolefin, rayon, silk, spandex, triacetate, and wool. The wrinkle reducing and deodorizing dryer sheets of the disclosed embodiments are also suitable for use with clothing and garments made from micro-fibers of acrylic, nylon and polyester as well as permanent press fabrics, which is a fabric that has been chemically processed to resist wrinkles to hold its shape.

The wrinkle reducing and deodorizing dryer sheets of the disclosed embodiments provide one or more benefits relative to prior art dryer sheets. They may also be used to treat damp or dried clothing. These benefits include one or more of the following: decreased propensity for garments to wrinkle during the drying process, decreased static in dry clothes, softer feel to the dried fabric, improved odor/scent to the fabric for improved freshening and improved repellence to pet hair. Also the user need not wash again clean wrinkled garments since the multilayered sheets will refresh and remove wrinkles from dried garments. The wrinkle reducing and deodorizing dryer sheets also allow the user to treat damp or dried clothing.

One of the unexpected and surprising findings in this disclosure is that the combination of hydrophilic and hydrophobic cationic ingredients in an absorbent flexible substrate with a polyvinyl alcohol substrate decreases the wrinkling of the fabrics during the rotary drying process. The hydrophilic and hydrophobic cationic ingredients are based on quaternary ammonium salts (also referred to as "quats" throughout the disclosure) with one or two long alkyl chains which decrease the water solubility of the molecules. For water soluble molecules, benzethonium chloride may be used, which consists of white crystals that are water soluble (IUPAC name is yl-2-{2-[4-(2,4,4-trimethylpentan-2yl)phenoxy] ethoxy}ethanaminium chloride). Another hydrophilic synthetic quaternary ammonium salt which may be used is benzalknoium chloride, also known as alkyldimethylbenyzlammoniumchloride, where the alkyl is usually a chain of n carbons consisting of 10, 12, 14, 16, or 18 carbons. Both compounds are strong biocidal agents, which are highly effective against pathogens and most viruses. Because of pricing and common use as a registered EPA disinfectant, benzalkonium chloride is used in the examples. Because of similar chemical properties, one could use combinations of benzalkonium and benzethonium chloride. A typical compound used as a hydrophobic quat is dipalmitoylethyl hydroxyethylmonium methosulfate. Other cationic compounds can be derived from imidazolium, substituted amine salts, or quaternary alkoxy ammonium salts. One preferred hydrophobic compound is dehydrogenated tallow dimethyl ammonium chloride (DTDAC). All these compounds including the new diquaternary polydimethylsiloxanes are characterized by their water repellency or hydrophobic nature. More particularly, when dihydrogenated tallow dimethyl ammonium chloride (DTDAC) at from 1 to 6 parts is combined with one part of benzalkonium chloride in a wet sheet (absorbent flexible substrate) along with a PVA sheet, the propensity for fabric wrinkling during the drying process decreases. The ratio of dihydrogenated tallow dimethyl ammonium chloride to benzalkonium chloride in a wet sheet may range 1:1 to 6:1 and is preferably 3:1. At the high temperatures encountered during the drying process, clothing and garments tend to shrink to a greater extent due to the elastic nature of the fibers which comprise them, which results in a greater propensity for wrinkling. The wrinkling subsides when the benzalkonium salts, which are water soluble, and sanitizers are mixed in a solution with the fatty acid quaternary salts for fabric conditioning, but which have minimal antimicrobial or sanitizing properties. Wrinkling is especially prevalent with cotton clothing, garments, and bedding. The wrinkling that occurs during the drying process necessitates the subsequent ironing of machine dried garments and clothing to remove wrinkles.

In one aspect of the disclosed embodiments, a wrinkle reducing and deodorizing dryer sheet is disclosed. The wrinkle reducing and deodorizing dryer sheet includes a combination of cationic ingredients with both fabric conditioning and antimicrobial properties The wrinkle reducing and deodorizing sheet also includes an absorbent flexible substrate in sheet form made from non-woven absorbent materials chosen from polyester, polyolefins, polyamides and combinations thereof.

In another aspect of the disclosed embodiments, methods of using a wrinkle reducing and deodorizing dryer sheet are disclosed. The methods include adding a wrinkle reducing and deodorizing dryer sheet/sheets to a rotary dryer with a load of wet garments for drying to reduce wrinkling in the garments, wherein the wrinkle reducing and deodorizing dryer sheet includes an absorbent flexible substrate in-sheet form including water soluble polyvinyl alcohol (PVA). The PVA sheets must have an optimal thickness in order to have anti-wrinkle properties. A PVA film of from 2 to 2.5 mils (thousands of an inch) thickness needs the support of a substrate sheet that is not water soluble. At the preferred thickness of 5 mil, one can add unsupported PVA sheets to the damp clothing to reduce wrinkling. At a thicknesses exceeding 5 mils, e.g., 8 mils, the PVA sheets maintain their form with negligible polymer transfer to the clothes in the dryer and thus do not contribute sufficient anti-wrinkle effects to the clothing.

In still yet another aspect of the disclosed embodiments, a method of making a wrinkle reducing and deodorizing dryer sheet is disclosed. The method includes providing an absorbent flexible substrate in a nonwoven form and periodically adhering a PVA sheet to one surface of the absorbent flexible substrate with liquid in such direction as to have the wet sheets in contact with the non-water soluble support sheets for the PVA surface. Refer to the FIGURE for the stacking arrangement of the sheets for this configuration. These can be individually dispensed from a suitable container for the tri-layered sheets, e.g., PVA sheet, support non water soluble sheet in contact with the absorbent liquid fill polyester sheet.

In still yet another aspect of the disclosed embodiments, the liquid containing antimicrobial and conditioning sheets (wet sheets) could be rolled and periodically perforated along the absorbent flexible substrate across the width of the roll to provide for ease of tear ability of conditioning and deodorizing dryer sheets from the roll, and then the roll of the conditioning and deodorizing dryer sheet placed in a cylindrical package with a perforated region or a cylinder with an openable end for subsequent dispensing. In a separate package, one may place individual, dry, PVA sheets for co-dispensing into the dryer with the wet sheets. This embodiment is referred to as wrinkle reducing and deodorizing dryer sheet kit including the wet sheets and the dry PVA sheets.

In one form, the wrinkle reducing and deodorizing dryer sheet of the disclosed embodiments includes an absorbent flexible substrate in sheet form with a polyvinyl alcohol sheet (also referred to as PVA or PVOH) adhered to one surface of the substrate. The PVA sheet is preferably in the form of a non-woven sheet. The PVA sheet may be adhered to the absorbent flexible substrate sheet with an adhesive or glue. The thickness of the adhesive or glue layer may range from 0.1 to 2 mils, or 0.1 to 1 mil, or 0.1 to 0.5 mils. The PVA sheet can be provided separately from the absorbent flexible substrate or as a single multilayered dryer sheet. The surface area of the PVA sheet is generally less than or equal to that of the absorbent flexible substrate sheet.

The absorbent flexible substrate sheet used in preparing the wrinkle reducing and deodorizing dryer sheets may be any of the substrates typically employed in making such sheets, since the only requirement for the substrate is that it be an absorbent flexible material in sheet form. For example, it may be a sponge, paper, or woven or non-woven sheet, and preferably a non-woven sheet made from fibers or filaments of a material such as wool, silk, jute, hemp, cotton, linen, sisal, ramie, rayon, cellulose esters, vinyl polymers, polyamide, polyesters, polypropylene and the like. A particularly desirable substrate is a sheet of non-woven polyethylene terephthalate (polyester).

A non-woven sheet is defined as a sheet or web structure bonded together by entangling fibers or filaments (and by perforating films) mechanically, thermally or chemically. They are flat, porous sheets that are made directly from separate fibers or from molten plastic or plastic film. The non-woven sheet may be produced from a synthetic or a natural fiber by known processes for producing non-woven fabrics. For example, with the use of synthetic fibers, a melt blowing or spun bonding process may be used. The non-woven sheet may be made from synthetic fibers, such as polyethylene, polypropylene, polyester, polyamide, polyvinylchloride, and polyvinyl acetate. One preferred non-woven sheet for use as an absorbent flexible substrate sheet in the wrinkle reducing and deodorizing dryer sheet is a polyester non-woven. The non-woven sheet must also have a sufficiently high melting point so as to not melt during the drying process. It is preferable that the flash point of the non-woven sheet or fabric be greater than 700° C.

As described above, the non-woven sheet may also include a combination of natural fibers and synthetic fibers, which may range from about 70% natural fibers and 30% synthetic fibers, to about 30% natural fibers and 70% synthetic fibers. The absorbent flexible substrate may also include non-ionic and cationic fabric conditioning agents, a perfume carrier, and a perfume. The thickness of the absorbent flexible substrate may range from 1 to 20 mil, or 2 to 15 mil, or 5 to 10 mil.

The absorbent flexible substrate sheet must be capable of retaining a variety of fabric treating compositions, otherwise known as active ingredients, in liquid form, and then transferring these active ingredients to clothes and garments during the rotary drying process via direct contact with the clothing and garments. As discussed above, the absorbent flexible substrate sheet is generally saturated with a solution including a combination of hydrophobic and hydrophilic cationic ingredients, but may also include other fabric treating compositions. Non-limiting exemplary active ingredients may include, anti-soil agents, anti-static agents, bacteriostatic agents, brightening agents, bodying agents, softening agents, dyes, fabric softeners, fiber emollients, finishing agents, fragrances, insect repellants, germicides, lubricants, mildew-proofing agents, moth-proofing agents, shrinkage controllers and sizing agents. Exemplary absorbent flexible substrate sheets are commercially available dry-type dryer sheets, such as Bounce® and Downy® from The Procter & Gamble Company and Snuggle® from The Sun Products Corporation. However, these dry dryer sheets are coated with antistatic and fabric conditioning agents that impart hydrophobic properties to the substrate making it non-water absorbent and water repellant.

PVA is a water-soluble synthetic polymer with excellent film-forming, emulsifying, and adhesive properties. This versatile polymer offers outstanding resistance to oil, grease and solvents, plus high tensile strength, flexibility, and high oxygen barrier. The PVA non-woven sheet of the disclosed embodiments may be formed by a variety of processes including putting small fibers together in the form of a sheet or web, and then binding them either mechanically (as in the case of felt, by interlocking them with serrated needles such that the inter-fiber friction results in a stronger fabric), with an adhesive, or thermally (by applying binder (in the form of powder, paste, or polymer melt) and melting the binder onto the web by increasing temperature. In a preferred form, the PVA non-woven sheet is made by melt-spun bonding, which does not require an adhesive or binder to get the fibers to adhere to one another. The PVA non-woven sheet may not only be melt spun bonded, but may also be a staple non-woven or a spun laid non-woven. The thickness of the PVA non-woven sheet selected may range from 0.5 to 8 mil, or 1 to 7 mil, or 2 to 6 mil, or 3 to 5 mil. PVA sheets thicker than 5 mil have less desirable anti-wrinkle properties. The PVA non-woven sheets may vary in size from 1 to 10 inches in length and 1 to 10 inches in width and preferably have a length by width of 3"×5" to 4"×4" uncoated and have an average weight of 0.2 to 0.5 grams. Sheets of this weight and size may be sufficient to treat up to 6 or 7 shirts in the dryer. For further details regarding the process used for making the PVA non-woven sheet, refer to U.S. Pat. No. 4,639,390, herein incorporated by reference in its entirety. A non-limiting exemplary non-woven PVA sheet is sold under the trademark Wash-n-Gone 541 by Pellon Industries and/or Sulky Stabilizer BTY by Solvy Industries.

In one form of using the wrinkle reducing and deodorizing dryer sheets of the disclosed embodiments, the absorbent flexible substrate sheet and the PVA sheet are provided as part of a two-part kit. This is referred to as the two-part kit embodiment for the wrinkle reducing and deodorizing dryer sheets. That is the absorbent flexible substrate sheet is packaged in one container and the PVA sheet is packaged in a separate container. In this form, also referred to as a wrinkle reducing and deodorizing dryer sheet kit, both a PVA sheet and an absorbent flexible substrate sheet are added separately to a rotary clothes dryer at the start of the drying cycle. During the drying process, the absorbent flexible substrate sheet activates the PVA sheet, which results in a slow transfer of PVA to the garments during the drying cycle which decreases the propensity for wrinkling.

In another form of using the wrinkle reducing and deodorizing dryer sheets of the disclosed embodiments, the absorbent flexible substrate sheet and the PVA sheet are provided as a single multi-layer sheet. This is referred to as the single multi-layer sheet embodiment for the wrinkle reducing and deodorizing dryer sheets. In this form, the absorbent flexible substrate sheet is adhered to the PVA sheet using a suitable natural or synthetic adhesive or glue. Non-limiting exemplary synthetics adhesives or glues for sticking the PVA sheet to the surface of the absorbent flexible substrate include urethanes, acrylics, epoxies, polyesters, cyanoacrylates, water and combinations thereof. Non-limiting exemplary natural adhesives are made from organic sources such as vegetable matter, starch (dextrin), natural resins or from animals e.g. casein or animal glue. Preferred synthetic and natural adhesives or glues are those that can withstand the temperature of a rotary dryer cycle (100 to 190 deg. F) without a loss in adhesive properties such that the PVA sheet will still be adhered to the surface of the absorbent flexible substrate sheet during the drying process. The adhesive or glue may be applied in the form of a hot melt adhesive, a cold contact adhesive or a pressure sensitive adhesive. Glue in the form of a cold contact adhesive is particularly preferred. Preferably the single multi-layer dryer sheet is added as a single unit or piece to a rotary clothes dryer and hence is packaged in a single container is sheet form.

In an alternative form of the single multi-layer sheet embodiment for the wrinkle reducing and deodorizing dryer sheets, the absorbent flexible substrate sheet and the PVA sheet may be separated with a water impermeable polymer layer or sheet sandwiched between the two sheets or layers. This water impermeable polymer layer or sheet may be a polyvinylchloride (PVC), or a polyethylene (PE), or polypropylene (PP), or other water insoluble polymer that prevents the direct contact of the absorbent flexible substrate sheet and the PVA sheet. One preferred water impermeable polymer layer is PVC. The thickness of the water impermeable polymer layer may range from 1 to 20 mil, or 2 to 15 mil, or 5 to 10 mil.

A glue or adhesive as described above may be used to adhere the water impermeable polymer layer to the PVA layer. The separation of the absorbent flexible substrate sheet from the PVA sheet prevents the activation of the PVA with aqueous components included in the absorbent flexible substrate sheet. FIGURE is cross-sectional view of an exemplary single multi-layer sheet embodiment for the wrinkle reducing and deodorizing dryer sheets, which includes PVA as one outer layer (layer 1 for sheet 1), a polyester non-woven soaked with quats as the other outer layer (absorbent flexible substrate) (layer 3 for sheet 1) and a PVC inner layer (water impermeable polymer layer) (layer 2 for sheet 1) separating the PVA layer and the polyester layer. The PVC inner layer (layer 2 for sheet 1) prevents the activation of the PVA in packaging, storage and transport by not allowing the PVA layer to directly contact the polyester soaked with quats layer.

In the single multi-layer sheet embodiment form of the FIGURE, storage occurs in single container in sheet form. FIGURE also depicts a novel method of stacking the single multi-layer wrinkle reducing dryer sheets in a single container to prevent the direct contact of PVA layer of one sheet with the PVA layer another sheet. That is the sheets are flipped alternatively in the container such that the PVA layer of one sheet does not contact the polyester soaked with quats layer of an adjacent sheet. In this form for packaging the single multi-layer wrinkle reducing dryer sheet embodiment, the polyester layers of adjacent sheets are in direct contact with each other and the PVA layers of adjacent sheets are in direct contact with each other. FIGURE depicts the container stacking arrangement for a total of 4 multi-layer wrinkle reducing dryer sheets. The single multi-layer wrinkle reducing dryer sheet embodiment provides ease to the user in terms of providing a single container including single stacked sheets of the dryer sheet for dispensing from the top of the container and then putting into a rotary clothes dryer.

The wrinkle reducing and deodorizing dryer sheet may also include an antioxidant agent, also known as a corrosion inhibitor or an anti-corrosive agent, as part of the absorbent flexible substrate sheet or layer, which functions to prevent rusting of the steel trap of the dryer during a drying cycle. Non-limiting exemplary corrosion inhibitors include alkali benzoates, amines, phosphates, tin salts, hydrazines, and combinations thereof.

The wrinkle reducing and deodorizing dryer sheet may also include as part of the aqueous solution of the absorbent flexible substrate sheet or layer, a disinfecting agent, also known as a disinfectant, which functions to kill bacteria during a drying cycle. Disinfecting agents kill or inhibit the growth of microorganisms such as bacteria, fungi, or protozoans. The disinfecting agent or disinfectant volatilizes at elevated temperatures during a drying cycle. Non-limiting exemplary disinfecting/disinfectant agents include propylene glycol, triethylene glycol, hydrogen peroxide, triclosan, benzalkonium chloride, benzethonium chloride, ethyl alcohol, propyl alcohol, formaldehyde, glutaraldehyde, sodium hypochlorite, calcium hypochlorite, chloramine, electrolyzed water, chlorine dioxide, peracetic acid, performic acid, phenolics, quaternary ammonium compounds, 2,4-dichlorobenzyl alcohol and combinations thereof. Non-limiting exemplary phenolics include o-phenylphenol, chloroxylenol, hexachlorophene, thymol, and amylmetacresol.

The wrinkle reducing and deodorizing dryer sheet may also include a perfuming or fragrance agent, also known as an aroma compound, as part of the absorbent flexible substrate sheet or layer. The perfuming or fragrance agent is a chemical compound that has a smell or odor, and functions to give a pleasant odor to clothes during the drying cycle. The fragrance agent volatilizes at elevated temperatures during a drying cycle. Non-limiting exemplary fragrance agents/aroma compounds include esters, linear terpenes, cyclic terpenes, aromatics, alcohols, ketones, fragrant aldehydes and combinations thereof.

During the drying process, the wrinkle reducing and deodorizing dryer sheet also provides anti-static properties to garments, which facilitates their removal from the dryer and their separation upon completion of the dryer cycle.

The wrinkle reducing and deodorizing dryer sheet of the disclosed embodiments may be used by being added to a load of wet clothes when put into the rotary drying machine for drying. The wrinkle reducing and deodorizing dryer sheet of the disclosed embodiments is particularly advantageous when used with a wet or dry load of clothes including cotton and permanent press garments. The wrinkle reducing and deodorizing dryer sheet contacts the wet or dry clothes during the drying cycle and the active ingredients on the absorbent flexible substrate transfer from the dryer sheet to the clothes or garments during the drying cycle. Likewise, the PVA sheet contacts the clothes and garments during the drying cycle and has been unexpectedly and surprisingly been found to reduce the level of wrinkling in the clothing and garments during the drying cycle. The water in the wet clothing and garments (or for dried clothing in the absorbent flexible substrate sheet) activates the PVA and upon contact, decreases the propensity for wrinkling during the drying cycle. The non-water soluble absorbent flexible substrate sheet also prevents the PVA sheet from adhering to the wet clothing during the drying process, which prevents the possible staining of the clothing. However, similar effects could be obtained using PVA sheets of thicker gauge (5 mil and up). The absorbent flexible substrate sheet also allows for the uniform release of the hydrophilic material from the PVA sheet to the garments during the drying process, which helps to reduce wrinkling. Not only does the wrinkle reducing and deodorizing dryer sheet of the disclosed embodiments decrease the propensity for wrinkling during the dryer process, but it also provides for the following other benefits: controls static, softens fabric, freshens fabric and helps repel pet hair.

In one form, a method of making a wrinkle reducing and deodorizing dryer sheet includes providing an absorbent flexible substrate in sheet form and a PVA sheet and adhering the PVA sheet to one surface of the substrate with an adhesive or glue, wherein the surface area of the PVA sheet is less than that of the absorbent flexible substrate sheet. In other form, a method of making a wrinkle reducing and deodorizing dryer sheet includes providing an absorbent flexible substrate layer or sheet, a water impermeable layer or sheet, and a PVA sheet, wherein the water impermeable layer or sheet is sandwiched between the absorbent flexible substrate layer or sheet and the PVA sheet to prevent the direct contact of the absorbent flexible substrate layer or sheet and the PVA sheet. A glue or adhesive is used adhere the PVA sheet or layer to the water impermeable inner layer or sheet. Also in this form, the surface area of the PVA sheet or layer may be less than that of the absorbent flexible substrate sheet or layer. In this form, utilizing single multi-layer wrinkle reducing dryer sheets, the sheets are cut and stacked as shown in the FIGURE in a single container for dispensing by the user.

In the alternative form of using the wrinkle reducing and deodorizing dryer sheets as a two-part kit, the PVA sheet and the absorbent flexible substrate sheets are packaged in separate containers to prevent the direct contact and activation of the PVA sheet by the absorbent flexible substrate sheet. In the two part kit form, the PVA and absorbent flexible substrate may be provided in either sheet form or in perforate roll form. For example, the absorbent flexible substrate sheet may be made by adding quats solution to a container that includes non-woven polyester in either sheet form or in perforated roll form. In this form, utilizing a two-part kit for the wrinkle reducing dryer sheets, the user would take a PVA sheet in roll form or stacked sheet form from one container and an absorbent flexible substrate sheet in roll form or stacked sheet form from another container and add both to a rotary clothes dryer. The absorbent flexible substrate sheet or the wet clothing initiates the activation of the PVA sheet for reducing the propensity for wrinkling during the drying cycle.

Alternatively, the method of making the wrinkle reducing dryer sheets in a single multi-layer form by providing the absorbent flexible substrate in roll form and periodically adhering a PVA sheet to one surface of the absorbent flexible substrate in the machine direction of the roll with an adhesive or glue, and also periodically perforating the absorbent flexible substrate across the width of the roll to provide for ease of tear ability of the wrinkle reducing and deodorizing dryer sheets from the roll before being stacked alternatively as shown in the FIGURE in a container. Again, the surface area of the PVA sheet may be less than the surface area of the absorbent flexible substrate roll to which it is adhered.

In an alternative method of making the wrinkle reducing dryer sheets in a single multi-layer form by providing the absorbent flexible substrate in roll form and periodically adhering a PVA sheet to one surface of the absorbent flexible substrate in the machine direction of the roll with an adhesive or glue, and placing a water impermeable release sheet of PE, PP or PVC between the PVA surface and the absorbent flexible substrate surface to keep the two surfaces from contacting each other and then periodically perforating the combination of the absorbent flexible substrate/PVA and water impermeable release sheet across the width of the roll to provide for ease of tear ability of the wrinkle reducing and deodorizing dryer sheets from a roll before being put into a rotary clothes dryer.

The roll of the wrinkle reducing and deodorizing dryer sheet described in the various embodiments may be then placed in a box with a perforated region or a cylinder or other container with an openable end for subsequent dispensing of individual dryer sheets by tearing across the perforated regions in the cross-machine direction. These perforations provide a means for the user to easily tear dryer sheets from the roll in the transverse direction. Alternatively, for the two-part kit embodiment for the wrinkle reducing and deodorizing dryer sheets, the PVA may be stored in sheet or perforated roll form in one container and the absorbent flexible substrate may be stored in sheet or perforated roll form in second container. Alternatively for the two-part kit embodiment, PVA may be stored in sheet or perforated roll form in one compartment of a single container and the absorbent flexible substrate may be stored in sheet or perforated roll form in a second compartment of the same container.

The container may be cylindrical in shape (for storing rolls) or rectangular in shape (for storing sheets) and is preferably fabricated from a cardboard or plastic. Non-limiting exemplary plastics that may be used to form the container include polyethylene, polypropylene, polyvinyl chloride, and polyester. The outside diameter of a cylindrical plastic container is larger than the outside diameter of the wrinkle reducing and deodorizing dryer sheet roll.

As described above, the PVA sheet is preferably in the form of a non-woven sheet. The surface area of the non-woven PVA sheet to the surface area of the absorbent flexible substrate may range from 5 to 80%, or 10 to 70%, or 15 to 60%. In another preferred method of making a wrinkle reducing and deodorizing dryer sheet, a micronized PVA polymer may be sprayed on the surface of the substrate to form a sheet-like coating.

Referring again to the FIGURE, depicted is a sheet stacking arrangement for the single multi-layer sheet embodiment of the wrinkle reducing and deodorizing dryer sheets. Sheet 1 (the top sheet of the stack) has the following 3-layer configuration:

Layer 1: PVA sheet to sticky side of layer 2,

Layer 2: PVC contact sheet glue on one side only (PVA side), and

Layer 3: Wet polyester sheet with mixture of quaternary ammonium salts.

Sheet 1 was used to treat the shirts in Examples 1 and 2 below. Layer 3 (wet polyester) of sheet 1 of three layer configuration must be stacked in sheet form to contact Layer (wet polyester) of sheet 2 as shown in the FIGURE to keep dry the PVA layers of adjacent sheets. In addition, the Layer 1 of sheet 2 must be stacked in sheet form to contact Layer 1 of sheet 3 such that the PVA layers of adjacent sheets are in contact with each other. This stacking arrangement continues throughout the container in order to keep the wet polyester layers of the multi-layer sheets from contacting the PVA layers of the multi-layer sheets. Alternatively, the multi-layer sheets can be separated from each other in a stacking configuration by separating them with dividers between adjacent multi-layer sheets, like plastic films or hydrophobic paper, in order to keep the wet polyester layer of one multi-layer sheet from contacting the PVA layer of an adjacent multi-layer sheet.

In the two-part kit embodiment of the wrinkle reducing and deodorizing dryer sheets, absorbent flexible substrate sheet or roll is packaged in a suitable plastic container including a roll or stacked sheets of non-woven polyester saturated with cationic conditioners and sanitizers. A solution of quaternized ammonium salts including both hydrophilic and hydrophobic molecules is then added to the absorbent flexible substrate in roll or sheet form. For example, the absorbent flexible substrate in the form of a roll of non-woven polyester may be placed in a cylindrical container to which the solution of quaternized ammonium salts is added. The roll is perforated for ease of dispensing and each wet sheet contains approximately 9 g of solution per 1 g of polyester substrate. The dry PVA sheets are stored in separate container and are added separately to the dryer and measure approximately 3×4 inches with a weight of 0.2 g per sheet. The "quats" as part of the absorbent flexible substrate may provide the humidity needed to activate the PVA sheet during the rotary drying process. The wet clothing also provides the humidity needed to activate the PVA sheet during the rotary drying process.

The following are examples of the disclosed embodiments and are not to be construed as limiting.

EXAMPLES

The degree of wrinkling of clothing and garments was quantified by developing a wrinkling grading scale ranging from 1 to 10. A garment with a wrinkle rating of 1 has heavy wrinkling and is too wrinkled to wear. A garment with a wrinkle rating of 5 has moderate wrinkling and is considered borderline for wearing. A garment with a wrinkle rating of 10 has no wrinkling and would be comparable to a finely ironed garment. The dried garments were judged both pre-drying and post-drying to determine the change in the wrinkle rating through the drying process. The wet garments were judged post-drying for the different treatments. The 100% cotton shirts tested had a wrinkle rating range of 2.5 to 4.5 with most shirts falling in the range of 3 to 4. These same 100% cotton shirts after being dried in a rotary clothes drying using the wrinkle reducing and deodorizing dryer sheet disclosed herein had a rating ranging from 6 to 8 with most shirts falling in the range of 6 to 8. Hence, there was a surprising and unexpected decrease in the degree of wrinkling of 100% cotton shirts during the drying process. More specifically, there was an increase in the wrinkle rating from 3-4 points per shirt upon drying with a wrinkle reducing and deodorizing dryer sheet disclosed herein. This signifies a large decrease in the amount of wrinkling occurring during the drying process. Generally, it is recognized that untreated garments become more wrinkled during the drying process, whereas it has been discovered the dryer sheet disclosed herein actually decreases the degree of clothes wrinkling during the dryer cycle. The dryer settings for experimental control purposes and for minimal shrinkage were always warm and 30 minutes timed.

The above described wrinkle rating scale was used to quantify the degree of wrinkling for various experiments using cotton and permanent press garments. For clean wrinkled garments, the pre-treatment steps after removing the shirts from storage cotton shirts were as follows:

a) Five dried cotton shirts were each given a wrinkle rating.

b) The five dried shirts were then placed in rotary dryer with a 30-minute timed permanent press cycle on a warm dryer temperature setting of approximately 40-50° C. A double-sided dryer sheet containing on one side 10 g water solution of 0.1% benzalkonium chloride (n=12, 14, 16, and 18) and 0.3% DTDAC and on the other side of the dryer sheet a 4"×4" PVA sheet weighing approximately 0.5 g was placed in the dryer c) The cotton shirts were removed from the dryer and hung on shirt wire hangers in preparation for wrinkle rating.

d) The five dried cotton shirts were each given a wrinkle rating.

Alternatively, the procedure used for dirty laundry permanent press or dirty cotton garments was the same as above except that in step a), the washing machine was also run through the warm/cold permanent press cycle and no pre-drying wrinkle rating given.

Example 1

Wrinkle Reducing and Deodorizing Dryer Sheet Embodiment

Wrinkle reducing and deodorizing dryer sheets (double sided as described above) were prepared and added to the wrinkled clean shirts removed from the closet. The wrinkle rating of the five cotton shirts before and after drying are included in Table 1 below.

TABLE 1

Before and after wrinkle ratings with wrinkle reducing and deodorizing dryer sheet

| Shirt # | Before treatment wrinkle rating | After drying wrinkle rating | Change in wrinkle rating |
|---|---|---|---|
| 1 | 3 | 7 | 3 |
| 2 | 3.5 | 5.5 | 2 |
| 3 | 2.5 | 5 | 2.5 |
| 4 | 3.0 | 6.0 | 3.0 |
| 5 | 4.0 | 6.5 | 2.5 |
| Average | 3.2 | 6.0 | 2.8 |

From Table 1, it can be seen that the wrinkle reducing and deodorizing double sided dryer sheet decreased the degree of wrinkling for each of the five cotton shirts. The average improvement in the wrinkle rating was almost 3 units per shirt. The improvement is very good and all the shirts were judged ready to wear.

Example 2

The same type wrinkle reducing and deodorizing dryer sheet (double sided described in Example 1) was added to wet clean shirts wash and rinsed in a washer through the permanent press cycle.

TABLE 2

Before and after wrinkle ratings with wrinkle reducing and deodorizing double-sided sheets as described in Example 1.

| Shirt # | Before drying wrinkle rating | After drying wrinkle rating | Change in wrinkle rating |
|---|---|---|---|
| 1 | 3.5 | 5.5 | 2.0 |
| 2 | 3.5 | 5.5 | 2.0 |
| 3 | 3 | 5.5 | 2.5 |
| 4 | 3 | 6.5 | 2.5 |
| 5 | 3 | 6.0 | 3.0 |
| Average | 3.1 | 5.5 | 2.4 |

From Table 2, it can be seen that the wrinkle reducing and deodorizing dryer sheet decreased the degree of wrinkling for each of the five cotton shirts. The average improvement in the wrinkle rating was 2.4/shirt. Hence, it can be concluded that the wrinkle reducing and deodorizing dryer sheet combination improves anti-wrinkling. All the shirts were graded ready to wear.

Comparative Example 3

Shirts Washed and then Dried with Bounce® Dryer Sheet

The wrinkle rating of the five cotton shirts washed with detergent in permanent press cycle and then treated with a Bounce® antistatic dryer sheet in a dryer are included in Table 3 below.

TABLE 3

Before and after wrinkle ratings with Bounce ® dryer sheet

| Shirt # | Before drying wrinkle rating | After drying wrinkle rating | Change in wrinkle rating |
|---|---|---|---|
| 1 | Not applicable | 4.0 | All shirts rated below 5.0 need ironing to wear |
| 2 | Not applicable | 4.5 | |
| 3 | Not applicable | 3.5 | |
| 4 | Not applicable | 3.5 | |
| 5 | Not applicable | 4.0 | |
| Average | n/a | 3.9 | n/a |

From Table 3, it can be seen that the wrinkle reducing properties of "hydrophobic quats" is minimal and all the treated shirts require ironing to eliminate wrinkles.

Comparative Example 4

Arm & Hammer—Total 2-in-1 Dryer Cloths®

For comparison purposes, Arm & Hammer Total 2-in-1 dryer Cloths® alone were evaluated during the drying process with a warm temperature setting for 30 minutes timed. These are wet dryer sheets or cloths which function to control static during the drying process and also give garments a fresh scent.

An Arm & Hammer Total 2-in-1 dryer cloth was added to the rotary clothes dryer using the procedure described above. The wrinkle rating of the four cotton shirts before and after drying are included in Table 4 below.

TABLE 4

Before and after wrinkle ratings with Arm & Hammer dryer cloth

| Shirt # | Before drying wrinkle rating | After drying wrinkle rating | Change in wrinkle rating |
|---|---|---|---|
| 1 | 3 | 6 | 3 |
| 2 | 1.5 | 3 | 1.5 |
| 3 | 4 | 6 | 2 |
| 4 | 3 | 3 | 0 |
| 5 | n/a | n/a | n/a |
| Average | 2.875 | 4.5 | 1.625 |

From Table 4, it can be seen that the Arm & Hammer wet dryer Sheet® decreased the degree of wrinkling sufficiently for two of the four cotton shirts. The average improvement in the wrinkle rating was 1.6 and only two shirts were rated usable without ironing.

Example 5

Two Dryer Sheet Combination

For comparison purposes, two dryer sheets added separately were evaluated during the drying process. The wet polyester with 10 g of blended quats solution/sheet was dispensed from a cylindrical roll of perforated sheets. Another sheet consisting of 0.5 g of PVA (5 mil thickness) and weighing 0.5 g was also added to the dryer. The sheets were added to a wash of five wet cotton shirts in the dryer.

The two dryer sheets were added to the rotary clothes dryer using the procedure described above, temperature warm for drying and drying time of 30 minutes. The wrinkle rating of the five cotton shirts before and after drying are included in Table 5 below.

TABLE 5

Before and after wrinkle ratings with a wet dryer sheet and a PVA dry sheet.

| Shirt # | Before drying wrinkle rating | After drying wrinkle rating | Change in wrinkle rating |
|---|---|---|---|
| 1 | 3.0 | 7.0 | 4.0 |
| 2 | 3.5 | 5.5 | 2.0 |
| 3 | 2.5 | 5.0 | 2.5 |
| 4 | 3.0 | 6.0 | 3.0 |
| 5 | 4.0 | 6.5 | 2.5 |
| Average | 3.2 | 6.0 | 2.8 |

From Table 5, it can be seen that the two dryer sheets used together and added separately decrease the degree of wrinkling for all of the five cotton shirts. All shirts were rated ready to wear without ironing.

Example 6

Two Dryer Sheet Combination

A mother of three Catholic school children that wear daily uniforms to school volunteered to evaluate the wet and dried mixed quats and PVA sheet system. She was told to use the system the same way she used Bounce® dryer sheets for other garment items. She never previously put the uniforms in the dryer because the uniforms always dried very wrinkled. She called us with the "amazing" results that the uniforms dried looking as if they were ironed for wrinkle removal after removed from the dryer with the wet and dried mixed quats and PVA sheet system.

In accordance with one or more aspects of a first disclosed embodiment, provided is a wrinkle reducing and deodorizing dryer sheet comprising: a polyvinyl alcohol first outer layer of less than 8 mils in thickness, a second outer layer of an absorbent flexible substrate including a solution of dihydrogenated tallow dimethyl ammonium chloride and benzalkonium chloride (alkyl includes n carbons wherein n=12, 14, 16, or 18), wherein the ratio of the dihydrogenated tallow dimethyl ammonium chloride to the benzalkonium chloride (alkyl includes n carbons wherein n=12, 14, 16, or 18), ranges from 1:1 to 6:1, and an inner layer between the first and second outer layers of a water impermeable polymer including an adhesive for adhering the inner layer to the absorbent flexible substrate layer. Similar water soluble quats to benzalkonium chloride could also be used for yielding similar benefits.

In accordance with one or more aspects of a second disclosed embodiment, provided is a wrinkle reducing and deodorizing dryer sheet comprising: a polyvinyl alcohol first outer layer of less than 8 mils in thickness, and a second outer layer of an absorbent flexible substrate including a solution of dihydrogenated tallow dimethyl ammonium chloride and benzalkonium chloride (alkyl includes n carbons wherein n=10, 12, 14, 16, or 18), wherein the ratio of the dihydrogenated tallow dimethyl ammonium chloride to the benzalkonium chloride (alkyl includes n carbons wherein n=10, 12, 14, 16, or 18) ranges from 1:1 to 6:1, and an adhesive layer between the first and second outer layers. Similar water soluble quats to benzalkonium chloride could also be used for yielding similar benefits.

In accordance with one or more aspects of a third disclosed embodiment, provided is a wrinkle reducing and deodorizing dryer sheet kit comprising: a perforated roll or stacked sheets of polyvinyl alcohol of less than 8 mils in thickness and a perforated roll or stacked sheets of an absorbent flexible substrate including a solution of dihydrogenated tallow dimethyl ammonium chloride and benzalkonium chloride (alkyl includes n carbons wherein n=10, 12, 14, 16, or 18), wherein the ratio of the dihydrogenated tallow dimethyl ammonium chloride to the benzalkonium chloride (alkyl includes n carbons wherein n=12, 14, 16, or 18) ranges from 1:1 to 6:1. Similar water soluble quats to benzalkonium chloride could also be used for yielding similar benefits.

Applicants have attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the disclosed embodiments. Accordingly, the disclosed embodiments is intended to embrace all such alterations, modifications, and variations of the above detailed description.

All patents, test procedures, and other documents cited herein, including priority documents, are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated.

What is claimed is:

1. A wrinkle reducing dryer sheet comprising: a first outer layer of a polyvinyl alcohol substrate having a thickness of from 0.5 to 8 mils, a second outer layer of an absorbent flexible non-woven substrate saturated with a solution including a combination of hydrophobic and hydrophilic cationic ingredients having a thickness of from 1 to 20 mils, and at least one water impermeable adhesive layer having a thickness of from 0.1 to 2 mils between the first outer layer and the second outer layer.

2. The wrinkle reducing dryer sheet of claim 1, wherein the polyvinyl alcohol substrate is a non-woven.

3. The wrinkle reducing dryer sheet of claim 2 wherein the non-woven polyvinyl alcohol substrate layer surface area is less than the surface area of the absorbent flexible non-woven substrate.

4. The wrinkle reducing dryer sheet of claim 3 wherein the surface area of the non-woven polyvinyl alcohol substrate layer ranges from 5 to 80% of the surface area of the absorbent flexible non-woven substrate.

5. The wrinkle reducing dryer sheet of claim 1, wherein the hydrophilic cationic ingredient is selected from the group consisting of benzethonium chloride, benzalknoium chloride, and combinations thereof.

6. The wrinkle reducing dryer sheet of claim 1, wherein the hydrophobic cationic ingredient is selected from the group consisting of dipalmitoylethyl hydroxyethylmonium methosulfate, compounds derived from imidazolium, substituted amine salts, quaternary alkoxy ammonium salts, dehydrogenated tallow dimethyl ammonium chloride, and combinations thereof.

7. The wrinkle reducing dryer sheet of claim 1, wherein the combination of hydrophobic and hydrophilic and cationic ingredients is a solution of dihydrogenated tallow dimethyl ammonium chloride and benzalkonium chloride, wherein the ratio of the dihydrogenated tallow dimethyl ammonium chloride to the benzalkonium chloride ranges from 1:1 to 6:1.

8. The wrinkle reducing dryer sheet of claim 1, wherein the alkyl group of benzalkonium chloride has n carbons selected from the group consisting of 12, 14, 16, and 18.

9. The wrinkle reducing dryer sheet of claim 1, wherein the absorbent flexible non-woven substrate is selected from the group consisting of wool, silk, jute, hemp, cotton, linen, sisal, ramie, rayon, cellulose esters, vinyl polymers, polyester, polypropylene, polyamide and combinations thereof.

10. The wrinkle reducing dryer sheet of claim 1, wherein the absorbent flexible non-woven substrate further includes one or more active ingredients selected from the group consisting of anti-soil agents, anti-static agents, bacteriostatic agents, brightening agents, bodying agents, softening agents, dyes, fabric softeners, fiber emollients, finishing agents, fragrances, insect repellants, germicides, lubricants, mildew-proofing agents, moth-proofing agents, shrinkage controllers and sizing agents.

11. The wrinkle reducing dryer sheet of claim 1 wherein the at least one water impermeable adhesive layer is selected from the group consisting of urethanes, acrylics, epoxies, polyesters, cyanoacrylates, starch, casein and combinations thereof.

12. The wrinkle reducing dryer sheet of claim 1 further including an inner layer of a water impermeable polymer positioned between the first outer layer and the second outer layer having a thickness ranging from 1 to 20 mil.

13. The wrinkle reducing dryer sheet of claim 1 wherein the inner layer of a water impermeable polymer is selected from the group consisting of polyvinylchloride, polyethylene and polypropylene.

14. The wrinkle reducing dryer sheet of claim 1, wherein the dryer sheets are stored in stacked sheet form in a container with adjacent sheets configured wherein the first outer layer of polyvinyl alcohol substrate from adjacent sheets are in contact with each other and the second outer layer of the absorbent flexible non-woven substrate from adjacent sheets are in contact with each other.

15. A wrinkle reducing dryer sheet kit comprising: a polyvinyl alcohol substrate having a thickness of from 0.5 to 8 mils packaged in perforated roll or stacked sheet form and an absorbent flexible non-woven substrate saturated with a solution including a combination of hydrophobic and hydrophilic cationic ingredients having a thickness of from 1 to 20 mils packaged in perforated roll or stacked sheet form, wherein the polyvinyl alcohol substrate and the absorbent flexible non-woven substrate are provided in one or two containers separated from one another during storage.

16. The wrinkle reducing dryer sheet kit of claim 15, wherein the polyvinyl alcohol substrate is a non-woven.

17. The wrinkle reducing dryer sheet kit of claim 15, wherein the hydrophilic cationic ingredient is selected from the group consisting of benzethonium chloride, benzalknoium chloride, and combinations thereof.

18. The wrinkle reducing dryer sheet kit of claim 15, wherein the hydrophobic cationic ingredient is selected from the group consisting of dipalmitoylethyl hydroxyethylmonium methosulfate, compounds derived from imidazolium, substituted amine salts, quaternary alkoxy ammonium salts, dehydrogenated tallow dimethyl ammonium chloride, and combinations thereof.

19. The wrinkle reducing dryer sheet kit of claim 15, wherein the combination of hydrophobic and hydrophilic and cationic ingredients is a solution of dihydrogenated tallow dimethyl ammonium chloride and benzalkonium chloride, wherein the ratio of the dihydrogenated tallow dimethyl ammonium chloride to the benzalkonium chloride ranges from 1:1 to 6:1.

20. The wrinkle reducing dryer sheet kit of claim 15, wherein the alkyl group of benzalkonium chloride has n carbons selected from the group consisting of 12, 14, 16, and 18.

21. The wrinkle reducing dryer sheet kit of claim 15, wherein the absorbent flexible non-woven substrate is selected from the group consisting of wool, silk, jute, hemp, cotton, linen, sisal, ramie, rayon, cellulose esters, vinyl polymers, polyester, polypropylene, polyamide and combinations thereof.

22. The wrinkle reducing dryer sheet kit of claim 15, wherein the absorbent flexible non-woven substrate further includes one or more active ingredients selected from the group consisting of anti-soil agents, anti-static agents, bacteriostatic agents, brightening agents, bodying agents, softening agents, dyes, fabric softeners, fiber emollients, finishing agents, fragrances, insect repellants, germicides, lubricants, mildew-proofing agents, moth-proofing agents, shrinkage controllers and sizing agents.

* * * * *